US008314038B2

(12) United States Patent
Rockenfeller et al.

(10) Patent No.: US 8,314,038 B2
(45) **Date of Patent: *Nov. 20, 2012**

(54) PENETRATION RESISTANT ARTICLES

(75) Inventors: Uwe Rockenfeller, Boulder City, NV (US); Kaveh Khalili, Boulder City, NV (US)

(73) Assignee: Rocky Research, Boulder City, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/193,497

(22) Filed: Jul. 28, 2011

(65) Prior Publication Data

US 2012/0178323 A1 Jul. 12, 2012

Related U.S. Application Data

(63) Continuation-in-part of application No. 12/688,649, filed on Jan. 15, 2010, now Pat. No. 8,124,547, which is a continuation-in-part of application No. 11/029,685, filed on Jan. 4, 2005, now Pat. No. 7,648,757.

(51) Int. Cl.

| | |
|---|---|
| ***B32B 27/04*** | (2006.01) |
| ***F41H 1/02*** | (2006.01) |
| ***B28B 23/00*** | (2006.01) |
| ***B32B 18/00*** | (2006.01) |

(52) U.S. Cl. ..... 442/86; 428/36.4; 428/174; 428/300.1; 2/2.5

(58) Field of Classification Search ..... None
See application file for complete search history.

(56) References Cited

U.S. PATENT DOCUMENTS

| | | | | |
|---|---|---|---|---|
| 4,311,630 | A | 1/1982 | Humphrey et al. | |
| 4,351,878 | A | 9/1982 | Harper-Tervet et al. | |
| 6,224,842 | B1 | 5/2001 | Rockenfeller et al. | |
| 6,736,194 | B2 | 5/2004 | Rockenfeller et al. | |
| 7,648,757 | B2 * | 1/2010 | Rockenfeller et al. | 428/292.1 |
| 7,722,952 | B2 | 5/2010 | Rockenfeller et al. | |
| 2006/0147710 | A1 | 7/2006 | Rockenfeller et al. | |

OTHER PUBLICATIONS

Department of Defense Handbook; Composite Materials Handbook, vol. 1, Ch. 3, pp. 2-3, Jun. 17, 2002.

* cited by examiner

*Primary Examiner* — Camie Thompson
(74) *Attorney, Agent, or Firm* — Knobbe Martens Olson & Bear, LLP

(57) ABSTRACT

A ballistic composite having a front impact surface and a back surface. The composite may include a plurality of layers of woven fabric of polarized ballistic fibers and a metal salt, oxide, hydroxide or hydride polar bonded onto the woven fibers. In addition, a substantially water impermeable coating composition can be applied onto the layers of the woven fibers and/or on the exterior of the composite. In addition, the layers of woven fabric adjacent to the front impact surface can differ in composition from the layers of woven fabric adjacent to the back surface. In addition, the weave fabric making up the composite may have a cover factor of between about 0.6 and about 0.98.

29 Claims, No Drawings

PENETRATION RESISTANT ARTICLES

CROSS-REFERENCE TO RELATED APPLICATIONS

This application is a continuation-in-part of U.S. patent application Ser. No. 12/688,649 filed Jan. 15, 2010 which is a continuation-in-part of U.S. patent application Ser. No. 11/029,685 filed Jan. 4, 2005 and now U.S. Pat. No. 7,648,757 issued on Jan. 19, 2010 and which are incorporated herein by reference.

BACKGROUND OF THE INVENTION

Penetration resistant anti-ballistic materials presently available for protecting vehicles, equipment, structures and personnel from small arms projectile penetration or penetration from flying shrapnel and the like are relatively expensive and heavy. In addition, the anti-ballistic materials that are light-weight do not always have sufficient strength to protect equipment and personnel from larger ballistic projectiles.

SUMMARY OF THE INVENTION

Described herein are innovative ballistic composites comprising laminations of fibrous substrate materials impregnated with crystalline salts which are ionically bonded to the fiber. The composites are relatively inexpensive, light-weight and cost-effective to manufacture, and may be produced in almost any shape, size and thickness, and are fully recyclable.

One aspect is a ballistic composite article having a front impact surface and a back surface. The ballistic composite article may include a plurality of layers of woven fabric of polarized ballistic fibers; a metal salt, oxide, hydroxide or hydride polar bonded on said woven fibers; and a substantially water impermeable coating composition on said layers of woven fibers and/or on the exterior of said composite, and wherein the layers of woven fabric adjacent to the front impact surface differ in composition from the layers of woven fabric adjacent to the back surface.

In general, there are three significant sources of energy dissipation by fibrous composites. These may be classified as follows: 1) the energy absorbed in tensile failure of primary yarns, 2) the energy converted into elastic deformation of secondary yarns, i.e., all other yarns, and 3) the energy converted to kinetic energy of the moving portion of the composite. The primary parameters that influence ballistic performance are associated with the material properties of the yarns, the fabric structure, the projectile geometry, impact velocity, the layer-to-layer interaction in multi-layered systems, the boundary conditions, and the friction between the yarns themselves and between the yarns and a projectile.

In one embodiment, the penetration resistant composites described herein comprise substrate materials having layers of woven polarized strands of ballistic fibers comprising glass, polyamide, polyphenylene sulfide, polyethylene, M-5, PBO, carbon or graphite fibers on which a selected metal, salt, oxide, hydroxide or metal hydride is polar bonded on the surface of the fibers at concentrations sufficient to form bridges of the salt, oxide, hydroxide or hydrides between adjacent substrate strands and/or substrate fibers. Single or multiple layers of the woven salt or hydride bonded fibers are coated with a substantially water impermeable coating material. The composites comprise panels or other shaped penetration resistant articles or products.

Embodiments of multi-layered composites of the present invention comprise substrates engineered by controlling the substrate and salt density of different layers whereby the composites may be designed, fabricated and optimized to meet selected and different ballistic requirements and specifications.

In one embodiment, the composite is designed whereby the face or front layers of the composite closest to the impact surface are less elastic as compared to more elastic layers adjacent to back of the composite. In some embodiments, the layers at the face or front of the composite may have more density than the layers at the back of the composite.

In one embodiment, the substrate comprises layers of woven yarn having a fabric tightness or weave density of between about 60% and about 98%, also know as the "cover factor" of at least about 0.6 and preferably up to about 0.98.

In another embodiment, the metal salt concentration in the substrate layers comprises at least 0.25 grams/cc and preferably up to about 0.60 grams/cc of open fabric weave volume.

In another embodiment, a ballistic panel or article comprises layers of woven fabric, and wherein the fabric weave of one or more layers at or adjacent to the front or impact surface of the panel or article have a higher weave density than one or more fabric layers at or adjacent to the back of the article or panel.

In another embodiment, a ballistic panel or article comprises layers of woven fabric having a metal salt bonded in the fabric layers and wherein the salt concentration in one or more fabric layers at or adjacent to the front or impact surface of the panel or article is greater than in one or more fabric layers at or near the back of the panel or article.

In yet another embodiment, the areal density of the composite panel or article is between about 1.5 lbs/sq. ft. and about 3 lbs/sq. ft., and more specifically between about 2 lbs/sq. ft. and about 2.8 lbs/sq. ft.

DETAILED DESCRIPTION

The penetration resistant composite products described herein may be fabricated from substrate materials comprising woven fibers of the substrate material. Such woven substrate materials can include ballistic fabrics or cloth, where the fibers or strands of fibers have been twisted or formed in a coherent form such as yarn or roving. Various or different weaving patterns may be used, including three-dimensional weaves such as plain weave, basket weave, satin weave, twill, etc. which yield multi-directional strength characteristics. It may also be preferred to finish or weave the edge of the fabric to avoid fraying as the fabric is handled. Thus, for example, a leno edge may be used to prevent raveling, especially useful when the fabric is cut in the warp direction, and with roving yarn to avoid undoing of the weave. In another embodiment, two or more layers of the substrate fabric may be interwoven or otherwise sewn or joined together. As will be described hereinafter, such interlocking of the layers improves the ballistic characteristics of the composite. Successive layers of the fibers may also be positioned along different axes so as to give the substrate strength in multiple directions.

It should be realized that the products and articles discussed herein may be components of a larger ballistic impact resistant device. For example, the layered, polar bonded articles discussed below may be inserted on top of, behind, or between layers of other anti-ballistic material. In one embodiment, the other anti-ballistic material includes layers of boron carbide, ceramic, iron or high tensile strength aluminum. In other embodiments, the layered, polar bonded articles discussed below may be part of anti-ballistic materials that include laminated polycarbonate or ultra-high molecular weight polyethylene.

In one embodiment, the ballistic composite article is made from a plurality of fabric layers, wherein each layer has a different composition than the other layers. In this s embodiment, the layers differ from one another in that they have a different elasticity than one another. In one embodiment the layers towards the back of the article are more elastic than layers at the front of the article. In one embodiment, the fabric at the back of the material is 10-20% more elastic than the material at the front of the article. In other embodiments, the fabric layers at the back of the article are 30%-40%, 40%-50%, 50%-60%, 60%-70%, 70%-80%, 80%-90%, or 90%-100% more elastic than the material at the front of the article. In another embodiment, the fabric layers at the back of the article are 2, 3, 4, 5, 6, 7, 8, 9, or 10 times more elastic than the layers at the front of the article.

In yet another embodiment, the composite article has a gradient of fabric elasticity that is less elastic at the front of the article, but gradually becomes more elastic towards the back of the article. For example, in an article with 10 layers, each layer from the front of the article to the back of the article is progressively more elastic. This structure imparts high structural strength in the front of the article, but more flexibility and elasticity towards the back of the article to help absorb impact forces from projectiles.

In another embodiment, the article comprises a plurality of sections, with each section having a plurality of one or more fabric layers. In this embodiment, each section may have different elasticity by varying the elasticity of the fabrics within a section. Thus, a section at the front of the article may have a low elasticity, while a section at the middle may have a higher elasticity, while a section at the back may have the relatively highest elasticity. In one embodiment, the article has 3, 4, 5, 6, 7, 8, 9, 10 or more sections and each section may have 1, 2, 3, 4, 5, or more fabric layers.

In another embodiment, the article may have a plurality of layers of woven fabric of polarized ballistic fibers that differ in composition by having differing weave densities from front to back of the article. For example, the weave density of the layers at the front of the article may be higher than the weave density at the back of the article. In one embodiment, the article has a plurality of layers, with each layer from the front to the back having a progressively lower weave density. In another embodiment, the article may have sections, with each section having one or more layers of fabric, and wherein each section has a differing weave density from the others. In one embodiment, each section of the article from the front to the back has a progressively lower weave density.

In still another embodiment, the article may have a plurality of layers of woven polar fibers, wherein the layers differ from one another in that the loading density of metal salts, oxides, hydroxides or hydrides that are polar bonded onto the woven fibers differ at the front impact side of the article compared to the back of the article. For example, the loading density of the layers at the front impact side may be greater than the loading density at the back side. In some cases this may provide advantages in that the front side would be denser to absorb more of the impact force, but less dense towards the back of the article in order to spread the impact force over a greater surface.

Alternatively, the loading density may be lower at the front impact side and greater at the back side. Under some circumstances it may be more preferable to have a lower density surface absorb the initial impact force, but have a higher density material absorb the final force within the article. It should be realized that these options may differ due to different uses, such when the article is protecting an individual person, a vehicle, or an aircraft. In some cases, the polar fiber may achieve a loading density on the fiber of at least about 0.25 grams per cc of open substrate volume. In other embodiments, the loading density may be 0.1, 0.2, 0.3, 0.4, 0.5, 0.6, 0.7, 0.8, 0.9, 1.0 or more grams per cc of open substrate volume. In some embodiments, the loading density decreases by a specific percentage in each layer of the article from front to back. For example, the layer closest to the front impact side may have a loading density of 0.3 grams per cc of open substrate volume, but that density is reduced by 5% for each additional layer of the article. In other embodiments, each layer of the article changes from front to back by at least 1%, 2%, 3%, 4%, 5%, 6%, 7%, 8%, 9%, or 10%. In other embodiments, the article has sections of layers, wherein the layers within each section have the same loading density, but the loading density between sections changes throughout the article.

In still another embodiment, layers may differ in composition because the different metal salts, oxides, hydroxides or hydrides that are bonded onto the polar fibers change in different layers of the article. For example, one layer may use $SrCl_2$ polar bonded to a polar fiber strand, while a second layer uses $CaBr_2$ and a third layer uses $CaCl_2$. In some embodiments each layer has a different polar bonded metal halide, oxide or hydroxide. In some embodiments, the article has a plurality of sections, wherein each section has layers with the same polar bonded metal salt, oxide, hydroxide or hydride. In this embodiment, the salt used in each section may differ in order to provide advantageous properties of the material.

The fiber materials of which the woven ballistic substrates can be made include glass, polyamide, polyphenylene sulfide, polyethylene, carbon or graphite fibers. Glass fibers are one type of fiber material since woven glass fibers are relatively inexpensive and woven glass fiber fabric is easy to handle and process in preparing the composites. Such glass fibers include S-glass, having a higher tensile strength as compared to E-glass. Glass fiber fabrics are also available in many different weave patterns. Polyamide materials or nylon polymer fiber strands are also useful. Aromatic polyamide resins (aramid resin fiber strands, commercially available as Kevlar®, Twaron® and Nomex®) are especially useful.

Another useful ballistic fiber strand material is made of polyphenylene sulfide, commercially available as Ryton®. Other useful ballistic fiber materials comprise Zylon® (poly-p-phenylene-2,6-benzobisoxazole); also known as PBO, Spectra® (polyethylene), and M-5 (diimidazole pyridinylene dihydroxy phenylene).

In another embodiment, combinations of two or more of the aforesaid materials may be used in making up the substrate, selected to take advantage of the unique properties of each of them. For example, different layers may comprise fabrics of different fibers, e.g., alternating fabric layers of S-glass and aramid yarns, respectively. In another embodiment, the substrate material comprises hybrid weaves using one fiber material yarn weave in a first direction and a different fiber material yarn in a second direction. An example of such a hybrid weave uses S-2 glass roving primary yarns and secondary yarns comprising aramid resin. In another example, different fiber materials are used in the warp and fill directions, respectively, e.g., glass fiber warp yarn and nylon and/or aramid fill yarn, or vice versa. Alternatively, the fibers used in warp and/or fill directions may be mixed, for example, in a plain weave, every 3rd warp and fill yarn may be a secondary yarn. Thus, any number of combinations of different fiber yarns may be used for fabrics and fabric layers.

The fabric weave density is also another feature of the substrate material that can provide advantages in preparing a composite. The fabric weave density is defined in terms of fabric tightness or "cover factor". For the ballistic panels, articles and products described herein, in one embodiment, the cover factor may be between about 0.6 and about 0.98, and alternatively between about 0.75 and about 0.98. The cover factor is a numerical expression of the fraction of the total surface area of the weave covered by the weave. Thus, for example, if 1 sq. in. of the weave cloth has a cover factor of 0.9, 90% of the cloth comprises woven fiber and the rest is open fiber material. Accordingly, the higher the cover factor number, the higher the weave density, and the tighter the weave pattern.

The surface of the fibers and fiber strands of the aforesaid substrate material may be polarized. Polarized fibers are commonly present on commercially available fabrics, weaves or other aforesaid forms of the substrate. If not, the substrate may be treated to polarize the fiber and strand surfaces. The surface polarization requirements of the fiber, whether provided on the substrate by a manufacturer, or whether the fibers are treated for polarization, should be sufficient to achieve a loading density of the salt on the fiber of at least about 0.25 grams per cc of open substrate volume in one embodiment, whereby the bonded metal salt bridges adjacent fiber and/or adjacent strands of the substrate. Polarity of the substrate material may be readily determined by immersing or otherwise treating the substrate with a solution of the salt, drying the material and determining the weight of the salt that has become polar bonded to the substrate. Alternatively, polar bonding may be determined by optically examining a sample of the dried substrate material and observing the extent of salt bridging of adjacent fiber and/or strand surfaces. Even prior to such salt bonding determination, the substrate may be examined to see if oil or lubricant is present on the surface. Oil coated material may, in some circumstances, substantially negatively affect the ability of the substrate fiber surfaces to form an ionic, polar bond with a metal salt or hydride. If surface oil is present, the substrate may be readily treated, for example, by heating the material to sufficient temperatures to burn off or evaporate the undesirable lubricant. Oil or lubricant may also be removed by treating the substrate with a solvent, and thereafter suitably drying the material to remove the solvent and dissolved lubricant. Substrates may also be treated with polarizing liquids such as water, alcohol, inorganic acids, e.g., sulfuric acid.

The substrate may be electrostatically charged by exposing the material to an electrical discharge or "corona" to improve surface polarity. Such treatment causes oxygen molecules within the discharge area to bond to the ends of molecules in the substrate material resulting in a chemically activated polar bonding surface. Again, the substrate material should be substantially free of oil prior to the electrostatic treatment in some embodiments.

In one embodiment, a metal salt, metal oxide, hydroxide or metal hydride, is bonded to the surface of the polarized substrate material by impregnating, soaking, spraying, flowing, immersing or otherwise effectively exposing the substrate surface to the metal salt, oxide, hydroxide or hydride. A preferred method of bonding the salt to the substrate is by impregnating, soaking, or spraying the material with a liquid solution, slurry or suspension or mixture containing the metal salt, oxide, hydroxide or hydride followed by removing the solvent or carrier by drying, heating and/or by applying a vacuum. The substrate may also be impregnated by pumping a salt suspension, slurry or solution or liquid-salt mixture into and through the material. Where the liquid carrier is a solvent for the salt, it may be preferred to use a saturated salt solution for impregnating the substrate. However, for some cases, lower concentrations of salt may be used, for example, where necessitated or dictated to meet permissible loading densities. Where solubility of the salt in the liquid carrier is not practical or possible, substantially homogeneous dispersions may be used. Where an electrostatically charged substrate is used, the salt may be bonded by blowing or dusting the material with dry salt, oxide, hydroxide or hydride particles.

As previously described, in some embodiments, it may be necessary to bond a sufficient amount of metal salt, oxide, hydroxide or hydride on the substrate to achieve substantial bridging of the salt, oxide, hydroxide or hydride crystal structure between adjacent fibers and/or strands. A sufficient amount of metal salt, oxide, hydroxide or hydride is provided by at least about 0.25 grams per cc of open substrate volume, preferably between about 0.25 and about 0.6 grams per cc. Following the aforesaid treatment, the material is dried in equipment and under conditions to form a flat layer, or other desired size and shape using a mold or form. A dried substrate will readily hold its shape. In one embodiment, the substrate is dried to substantially eliminate the solvent, carrier fluid or other liquid, although small amounts of fluid, for example, up to 1-2% of solvent, can be tolerated without detriment to the strength of the material. Drying and handling techniques for such solvent removal will be understood by those skilled in the art.

The metal salts, oxides or hydroxides bonded to the substrate are alkali metal, alkaline earth metal, transition metal, zinc, cadmium, tin, aluminum, double metal salts of the aforesaid metals, and/or mixtures of two or more of the metal salts. The salts of the aforesaid metals may be halide, nitrite, nitrate, oxalate, perchlorate, sulfate or sulfite. The preferred salts comprise halides, and preferred metals comprise strontium, magnesium, manganese, iron, cobalt, calcium, barium and lithium. The aforesaid preferred metal salts provide molecular weight/electrovalent (ionic) bond ratios of between about 40 and about 250. Hydrides of the aforesaid metals may also be useful, examples of which are disclosed in U.S. Pat. Nos. 4,523,635 and 4,623,018, incorporated herein by reference in their entirety.

Following the drying step or where the salts are bonded to dry, electrostatically charged substrate, if not previously sized, the material is cut to form layers of a desired size and/or shape, and each layer of metal salt or hydride bonded substrate material or multiple layers thereof are sealed by coating with a substantially water-impermeable composition. The coating step may be carried out under conditions or within a time so as to substantially seal the composite thereby preventing the metal salt or hydride from becoming hydrated via moisture, steam, ambient air, or the like, which may cause deterioration of strength of the material. The timing and conditions by which the coating is carried out will depend somewhat on the specific salt bonded on the substrate. For example, calcium halides, and particularly calcium chloride and calcium bromide will rapidly absorb water when exposed to atmospheric conditions causing liquefaction of the salt and/or loss of the salt bond and structural integrity of the product. Substantially water-impermeable coating compositions include epoxy resin, phenolic resin, neoprene, vinyl polymers such as PBC, PBC vinyl acetate or vinyl butyral copolymers, fluoroplastics such as polychlorotrifluoroethylene, polytetrafluoroethylene, FEP fluoroplastics, polyvinylidene fluoride, chlorinated rubber, and metal films including aluminum and zinc coatings. The aforesaid list is by way of example, and is not intended to be exhaustive. Again, the coating may be applied to individual layers of substrate, and/or to a plurality of layers or to the outer, exposed surfaces of a plurality or stack of substrate layers.

The aforesaid ballistic composites provide ballistic protection described in terms of areal density, which is the weight per unit area, expressed in pounds per square feet. The instant composites provide ballistic protection over a range of areal densities of between about 2 lbs/sq. ft. and about 3 lbs/sq. ft., and more specifically between about 2.2 lbs/sq. ft. and about 2.8 lbs/sq. ft.

In one embodiment, the ballistic composites described herein are characterized by having greater fabric weave density in the substrate layers at, near or adjacent to the front or impact surface of the article. Such tighter fabric weave layers result in greater substrate density and give the higher density layers less elasticity for more impact resistance and greater energy absorption. Thus, for example, fabric weave cover factors of 0.8, 0.9 and as high as 0.98, respectively, give less elasticity and offer greater penetration resistance and ballistic protection.

As previously described, the ballistic composites also incorporate metal salts, oxides, hydroxide or hydride bonded to the woven fabric fibers in concentrations of about 0.25 grams/cc to about 0.6 grams/cc of open substrate volume. In some embodiments, the ballistic composites incorporate metal salts, oxides, hydroxide or hydride bonded to the woven fabric fibers in concentrations of about 0.3 grams/cc to about 0.5 grams/cc of open substrate volume. The greater the salt concentration, the less elasticity of the fabric layer. Thus, greater salt concentrations in fabric layers at, near or adjacent to front or impact surface of the article provide more impact resistance and energy absorption.

By selecting and manipulating different fabric weave densities and different salt densities within the aforesaid ranges in different layers of the composite, both the desired ballistic protection and the weight characteristics of the resulting panels or articles may be designed to meet and satisfy a range of specifications desired or required for different products for different environments, uses and conditions. Thus, for example, for some uses or environments, for maximized ballistic protection, it may be desirable to utilize both high weave density and/or salt density in layers at or near the impact surface of the panel or article. For other specifications, it may be desirable to utilize lower salt density and/or lower weave density at or near the rear surface of the panel or article. Moreover, different combinations of weave and salt densities may be selected throughout the composite panel layers to achieve any desirable weight and strength characteristics or specifications of an article.

Panels or other forms and geometries such as concave, convex or round shapes of the aforesaid coated substrate composites such as laminates are formed to the desired thickness, depending on the intended ballistic protection desired, in combination with the aforesaid composites to further achieve desired or necessary performance characteristics. For example, useful panels or laminates of such salt bonded woven substrates may comprise 10-50 layers per inch thickness. Such panels or laminates may be installed in doors, sides, bottoms or tops of a vehicle to provide armor and projectile protection. The panels may also be assembled in the form of cases, cylinders, boxes or containers for protection of many kinds of ordnance or other valuable and/or fragile material such as ammunition, fuel and missiles as well as personnel. Laminates may include layers of steel or other ballistic resistant material such as carbon fiber composites, aramid composites or metal alloys.

The aforesaid composites may also be readily molded into articles having contoured and cylindrical shapes, examples of which include helmets, helmet panels or components, vests, vest panels, shoes, leg, hip, and buttocks protection components, as well as vehicle protection panels, vehicle body components, rocket or missile housings and rocket or missile containment units, including NLOS (non line of sight) systems. Such housings and containment units would encase and protect a rocket or missile and are used to store and/or fire missiles or rockets and could be constructed using the composites described herein to protect their contents from external objects such as bullets or bomb fragments. Vest panels of various sizes and shapes may be formed for being inserted into pockets located on or in the lining of existing or traditional military vests, or inserted in trousers or other clothing. The combined use of such panels with more traditional bulletproof vests may result in a lighter, more flexible, and more readily adaptable vest that accommodates the variety of sizes for different individuals. Similarly, one embodiment is a helmet panel that has been contoured to fit inside as a liner for a traditional helmet. In another embodiment, the protective composite panel is secured on the outside of the helmet with flexible and/or resilient helmet covers, netting, etc. In a different embodiment, the helmet may include one or more contoured or shaped composites as described herein to protect the wearer from bullets or bomb fragments.

For penetration resistant vehicular armor, many different sized and shaped protection panels may be formed of the composite including floor, door, side and top panels as well as vehicle body components contoured in the shape of fenders, gas tank, engine and wheel protectors, hoods, and the like. As used herein, "vehicle" includes a variety of machines, including automobiles, tanks, trucks, helicopters, aircraft and the like. Thus, the penetration resistant vehicle armor may be used to protect the occupants or vital portions of any type of vehicle.

The aforesaid composite articles may also be combined with other ballistic and penetration resistant panels of various shapes and sizes. For example, the aforesaid composites may be paired with one or more layers or panels of materials such as steel, aramid resins, carbon fiber composites, boron carbide, or other such penetration resistant materials known to those skilled in the art including the use of two or more of the aforesaid materials, depending on the armor requirements of the penetration resistant articles required.

The following Samples I-III of composite panel layers described above illustrate variations of ballistic properties by changing the salt density. In each test panel, 10 substrate layers are used, each layer is coated with epoxy resin, each panel is 0.5 in. thick.

Sample I

Substrate: 2033 TEX S-2 glass roving, plain weave, leno edge
warp: 5.5 yarns/in.
fill: 5.5 yarns/in.
Salt: $CaBr_2$ (0.46 g/cc open substrate volume)
Cover factor: 0.95-0.96
Areal density: 2.8 lbs/sq. ft.
Kinetic energy (KE) reduction: 348 J-358 J Sample II Substrate: 2033 TEX S-2 glass roving, plain weave, leno edge
warp: 5.5 yarns/in.
fill: 5.5 yarns/in.
Salt: $CaBr_2$ (0.58 g/cc open substrate volume)
Cover factor: 0.95-0.96
Areal density: 2.8 lbs/sq. ft.
KE reduction: 322 J-413 J Sample III Substrate: 2033 TEX S-2 glass roving, plain weave, leno edge
warp: 5.5 yarns/in.
fill: 5.5 yarns/in.
Salt: $CaBr_2$ (0.32 g/cc open substrate volume)
Cover factor: 0.97
Areal density: 2.2 lbs/sq. ft.
KE reduction: 200 J-335 J Sample IV illustrates the ballistic benefits by sewing or joining adjacent layers of fabric.

Sample IV

Substrate: 2033 TEX S-2 glass roving, plain weave, leno edge, 3-4 rovings sewn together every ¼ in. in warp and fill directions with S-2 thread
warp: 5.5 yarns/in.
fill: 5.5 yarns/in.
Salt: $CaBr_2$ (0.42 g/cc open substrate volume)
Cover factor: 0.95-0.96
Areal density: 2.8 lbs/sq. ft.
KE reduction: 401 J-494 J In the above sample tests, the kinetic energy (KE) reduction is expressed in joules (J)=0.5×(projectile mass)×(striking or muzzle velocity)$^2$ minus 0.5×(projectile mass)×(measured velocity after projectile exits panel)$^2$. Two chronographs placed in front and behind a test panel measure the striking and exit velocities. KE reduction of projectiles failing to penetrate a panel=0.5×(projectile mass)×(striking or muzzle velocity)$^2$. The projectiles were fired from a military issued Beretta M9 pistol firing 9 mm 124-grain full metal jacket bullets at 20 yards.

What is claimed is:

1. A ballistic composite article having a front impact surface and a back surface comprising:
a plurality of layers of woven fabric of polarized ballistic fibers;
a metal salt, oxide, hydroxide or hydride polar bonded on said woven fibers; and
a substantially water impermeable coating composition on said layers of woven fibers and/or on the exterior of said composite, and wherein the layers of woven fabric adjacent to the front impact surface differ in composition from the layers of woven fabric adjacent to the back surface.

2. A composite article of claim 1, wherein the polarized ballistic fibers have a cover factor of between about 0.6 and 0.98 and wherein the layers of woven fabric adjacent the front impact surface have a greater cover factor than the layers of woven fabric adjacent the back surface.

3. A composite article of claim 1, wherein the metal salt, oxide, hydroxide or hydride concentration is greater in the layers of woven fabric adjacent to the front impact surface than the layers of woven fabric adjacent to the back surface.

4. A composite article of claim 1 wherein the cover factor of one or more layers of woven fabric adjacent to the front impact surface is greater than about 0.9.

5. A composite article of claim 1 wherein the layers of woven fabric adjacent to the front impact surface have a lower elasticity than the layers of woven fabric adjacent to the back surface.

6. A composite article of claim 5, wherein the article comprises sections of layers of woven fabric, and wherein the layers within each section have the same elasticity.

7. A composite article of claim 5, wherein the layers of woven fabric have a gradient of elasticity from the front impact surface to the back surface.

8. A composite article of claim 1 wherein the layers of woven fabric adjacent to the front impact surface have higher loading density of metal salt, oxide, hydroxide or hydride polar bonded on said woven fibers than the layers of woven fabric adjacent to the back surface.

9. A composite article of claim 8, wherein loading density of the layers of woven fabric varies from 0.25 g/cc to about 0.60 g/cc of open fabric volume.

10. A composite article of claim 1 wherein the layers of woven fabric adjacent to the front impact surface have different metal salt, oxide, hydroxide or hydride molecules polar bonded on the woven fibers in comparison to the layers of woven fabric adjacent to the back surface.

11. A composite article of claim 1, wherein the article comprises an article of body armor configured to protect a person.

12. A composite article of claim 1, wherein the article comprises a panel of vehicle armor configured to protect a vehicle.

13. A composite article of claim 1, wherein the ballistic fibers comprise S-2 glass, polyamide, polyphenylene sulfide, polyethylene, carbon or graphite fibers.

14. A composite article of claim 1, comprising 10 to 50 layers of woven polarized ballistic fibers per inch of article thickness.

15. A composite article of claim 1, wherein the metal salt comprises one or more of an alkali metal, alkaline earth metal, transition metal, zinc, cadmium, tin, aluminum, or double metal salts.

16. A composite article of claim 1, wherein the metal salt comprises a halide, nitrite, nitrate, oxalate, perchlorate, sulfate or sulfite of the metal.

17. A composite article of claim 1, wherein the polarized ballistic fibers comprise aromatic polyamide resin fibers.

18. A composite article of claim 1, wherein the substantially water impermeable coating composition comprises a resin.

19. A composite article of claim 1, wherein the fabric comprises a combination of S-2 glass and aromatic polyamide resin fibers.

20. A composite of claim 1, wherein different fabric layers comprise different ballistic fibers.

21. A composite of claim 1, wherein alternating layers of fabric comprise different ballistic fibers.

22. A composite of claim 1, wherein the fabric comprises a woven mixture of two or more different ballistic fibers.

23. A composite article of claim 1, having an areal density of between about 2.2 lbs/sq. ft. and about 2.8 lbs/sq. ft.

24. A composite article of claim 1, wherein the metal salt, oxide, hydroxide or hydride concentration is between about 0.25 grams/cc and about 0.60 grams/cc of open fabric weave volume.

25. A ballistic composite having a front impact surface and a back surface comprising:
a plurality of layers of woven ballistic fabric having a cover factor of between about 0.6 and about 0.98;
a metal salt polar bonded on said woven fabric in a concentration of between about 0.25 g/cc and about 0.60 g/cc of open fabric volume;
the exterior of said composite sealed with a substantially water impermeable composition; and
wherein one or more layers of said fabric adjacent to said front impact surface have a greater cover factor and/or a greater metal salt concentration than one or more layers of said fabric adjacent to said back surface.

26. A ballistic composite of claim 25, wherein the woven fabric comprises fibers of S-2 glass, polyamides, aromatic polyamides, polyethylene, polyphenylene sulfide or combinations of two or more thereof.

27. A ballistic composite of claim 25, wherein two or more layers of the fabric are interwoven or sewn together.

28. A ballistic composite of claim 25 wherein the cover factor is greater and the concentration of metal salt is greater in one or more layers of fabric adjacent to said front impact surface than the concentration in one or more layers of fabric adjacent to said back surface.

29. A ballistic composite of claim 25 wherein the cover factor of one or more layers of fabric adjacent to said front impact surface is above about 0.9.

* * * * *